United States Patent [19]

Czerner et al.

[11] 3,997,969

[45] Dec. 21, 1976

[54] ELECTRIC DRY SHAVER

[75] Inventors: Peter A. Czerner, Trumbull; Robert Earl Davis, North Branford, both of Conn.

[73] Assignee: Sperry Rand Corporation, Bridgeport, Conn.

[22] Filed: June 4, 1975

[21] Appl. No.: 583,611

[52] U.S. Cl. ..... 30/43.92; 30/346.51; 30/346.61

[51] Int. Cl.[2] ..... B26B 19/02

[58] Field of Search ..... 30/34.1, 43.7, 43.8, 30/43.9, 43.91, 43.92, 346.51, 346.61; 16/149, 169

[56] References Cited

UNITED STATES PATENTS

| | | | |
|---|---|---|---|
| 3,552,006 | 1/1971 | Baumann | 30/34.1 |
| 3,590,482 | 7/1971 | Carr | 30/34.1 |
| 3,774,300 | 11/1973 | König | 30/346.51 X |
| 3,805,325 | 4/1974 | Lee | 16/169 X |
| 3,853,371 | 12/1974 | Bienert | 16/169 X |

FOREIGN PATENTS OR APPLICATIONS

| | | | |
|---|---|---|---|
| 1,036,915 | 7/1966 | United Kingdom | 30/43.91 |

*Primary Examiner*—Gary L. Smith
*Attorney, Agent, or Firm*—Charles R. Miranda

[57] ABSTRACT

An electric dry shaver is disclosed having an improved outer cutter which is rotatably repositionable or readily demountable by the user for cleaning hair debris from a hair chamber of the shaver.

10 Claims, 8 Drawing Figures

Fig. 7.
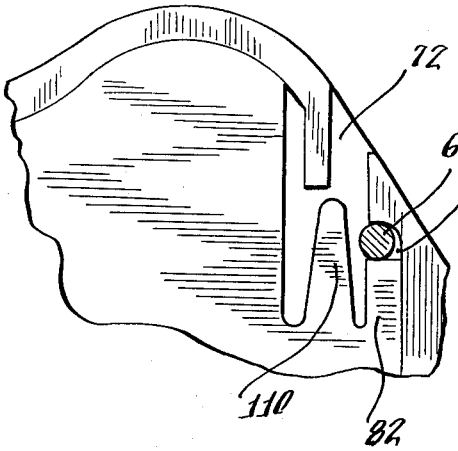
Fig. 4.
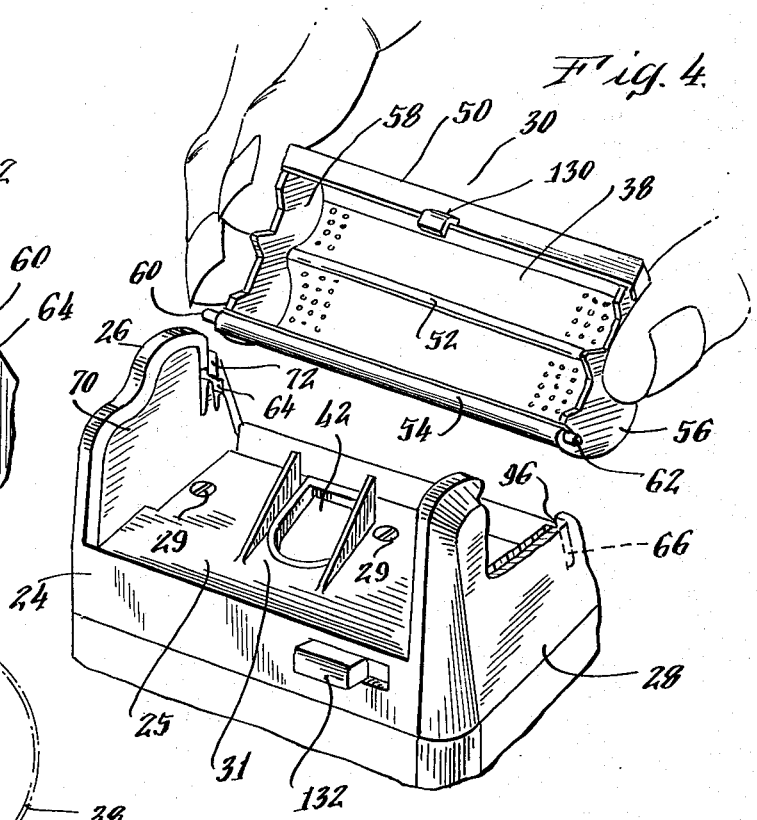
Fig. 6.
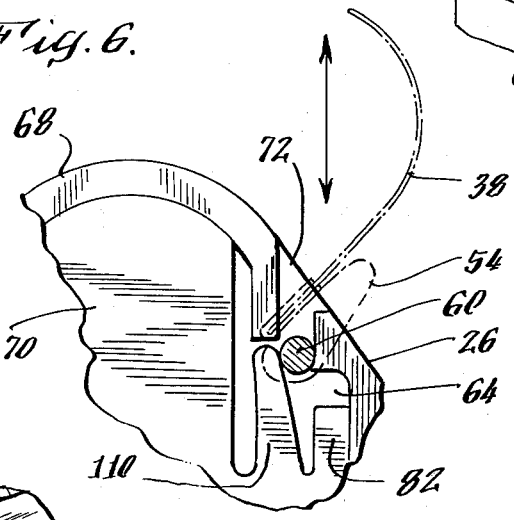
Fig. 5.
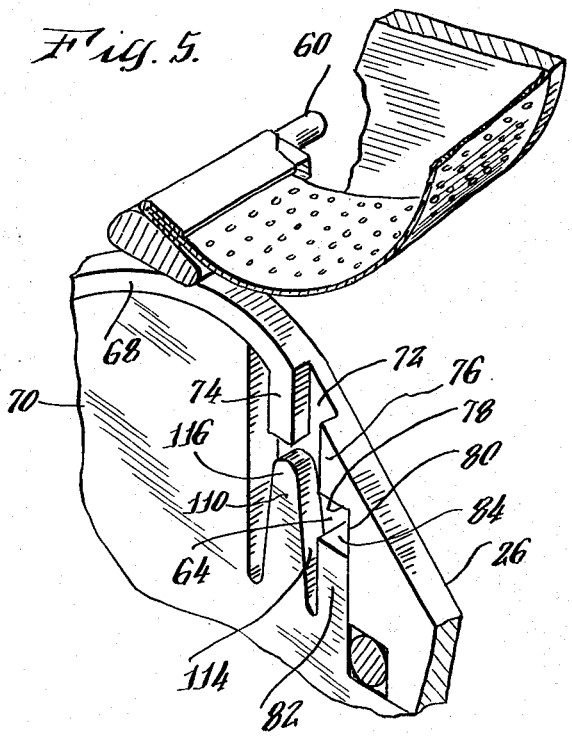
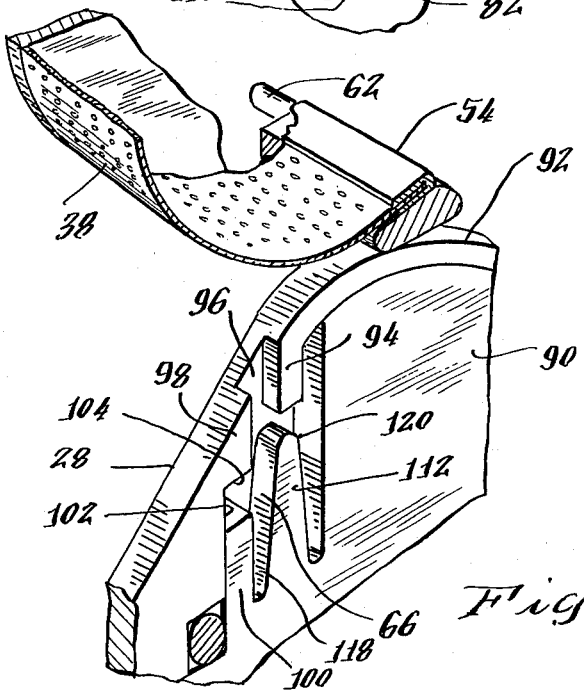
Fig. 8.

ELECTRIC DRY SHAVER

BACKGROUND OF THE INVENTION

This invention relates to new and useful improvements in electric dry shavers. The invention relates more particularly to an improved cutter head arrangement which facilitates cleaning and servicing the shaver.

A known form of electric dry shaver comprises a cutter head which is supported by a casing and an electric drive means positioned within the casing for actuating cutter blades of the head. A shroud is positioned between the cutter head and the casing for inhibiting the passage of hair particles from the cutter head into the casing. During operation, hair particles are collected in a hair chamber. This chamber is formed in the cutter head by side wall members and by a pivotally mounted outer cutter. The outer cutter in one shaver arrangement comprises a stationary, apertured surface or foil which cooperates with internally located cutter blades. It can be rotated by the user for exposing the chamber in order to remove collected hair debris from the cutter head. While the pivotally mounted outer cutter provides adequate access to the chamber, at times it would be preferable to more fully expose the chamber. It would be advantageous to provide an outer cutter which is pivotally mounted for enabling routine cleaning of the chamber and which is also demountable for less frequent, thorough cleaning by a user and for replacement of parts when necessary.

Accordingly, it is an object of this invention to provide a novel mounting arrangement for the outer cutter of a hair chamber in an electric dry shaver.

Another object is to provide an improved pivotally supported outer cutter which can be readily dismounted without disassembly.

SUMMARY OF THE INVENTION

In accordance with a feature of the invention, an electric dry shaver having an improved pivotally supported, demountable outer cutter is provided. The shaver comprises a shaver casing and a cutter head which includes an outer cutter. The cutter head defines a hair chamber for accumulating cut hair particles. A means is provided for pivotally supporting the outer cutter on the cutter head whereby the outer cutter is rotatable on the cutter head for exposing the hair chamber. A resilient means is also provided for restraining the outer cutter at the support means. The resilient means is adapted to be deflected upon forceful contact by the outer cutter thereby enabling the removal or positioning of the outer cutter at the support means.

These and other objects and features of the invention will become apparent with reference to the following specification and the drawings wherein one embodiment of the invention is illustrated.

DESCRIPTION OF THE DRAWINGS

In the drawing:

FIG. 4 is a rear perspective view of a portion of the shaver with a portion of a sidewall broken away of FIG. 1 illustrating an outer cutter of the shaver in a demounted position;

FIG. 5 is an enlarged fragmentary perspective view of one side of a cutter head of the shaver of FIG. 4;

FIG. 6 is an enlarged, fragmentary side elevation view of a portion of the shaver of FIG. 5 illustrating a portion of the outer cutter in a partially mounted position;

FIG. 7 is an enlarged, fragmentary, side elevation view of a portion of the shaver of FIG. 5 illustrating a portion of the outer cutter in a mounted position; and FIG. 8 is an enlarged, fragmentary perspective view of another opposite side of a cutter head of the shaver of FIG. 4.

DETAILED DESCRIPTION

Figure 1:
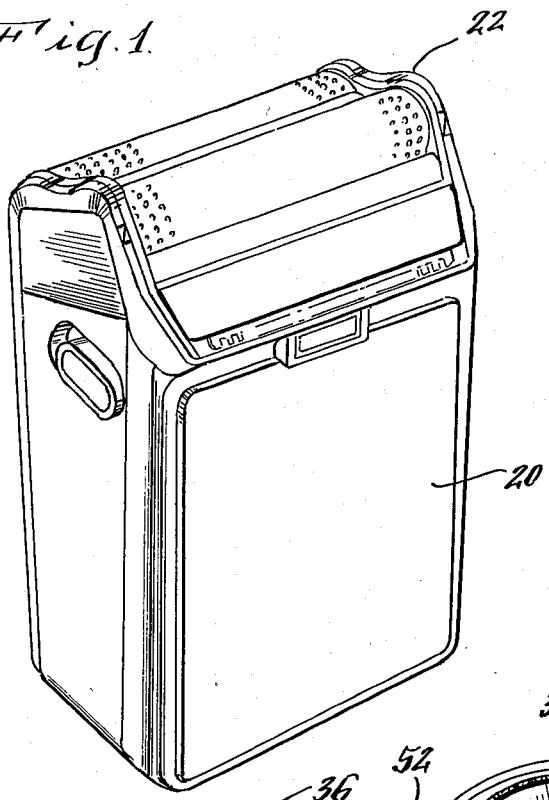
FIG. 1 is a front perspective view of an electric dry shaver constructed in accordance with the features of this invention.

Referring now to the drawings, an electric dry shaver is illustrated and is shown in FIG. 1 to include a casing indicated generally by reference numeral 20 and a cutter head indicated generally by reference numeral 22. The cutter head includes a frame 24 having a surface 25 thereof as best seen in FIG. 4 which is integrally formed with upstanding side wall members 26 and 28. Frame 24 is mounted by screws 29 to a shroud 31. The shroud is mechanically coupled to a drive reaction arm, not illustrated. There is also included in the cutter head 22 an apertured, stationary, outer cutter 30 which extends between the side wall members 26 and 28. A space enclosed by the surface 25 and the side walls 26 and 28 of the frame 24 and by a surface of the outer cutter 30 comprises a hair chamber in which hair particles accumulate during shaving.

Figure 3:
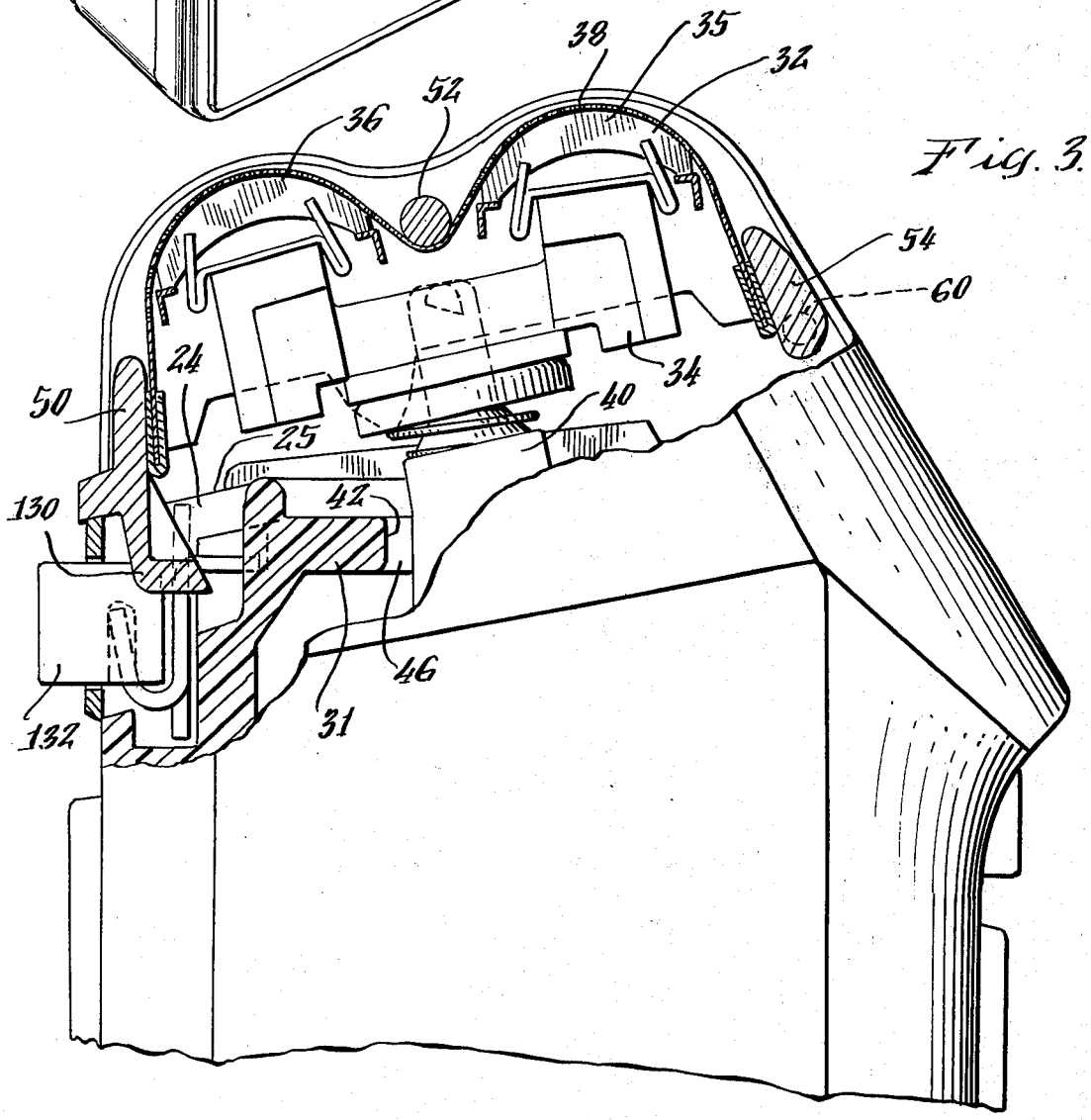
FIG. 3 is an enlarged side elevation view, partly broken away, of a portion of the shaver of FIG. 1.

An interior cutter which is indicated generally in FIG. 3 by the reference numeral 32 is provided and operates in cooperation with the apertured, stationary outer cutter 30 to shear facial hairs. The cutter 32 comprises a support body 34 having longitudinally extending blade arrays 35 and 36 mounted thereon. The blade arrays which include quarter-moon shaped cutter blades conforming in shape with an apertured cutter foil 38 of the outer cutter 30 are reciprocated in a longitudinal direction by a drive shaft 40. The drive shaft 40 is connected to the blade support body 34 and extends through an aperture 42 formed in the shroud 31 into the interior of the casing 20 where it is coupled to an electrically energized drive means, not illustrated. A resilient packing 46 which is formed of a foamed plastic, for example, is positioned in the aperture 42. During the shaving operation, hair particles which collect in the hair chamber are inhibited by the shroud 31 from passing into the casing 20 where they would collect and eventually interfere with the proper operation of the electric drive means.

In accordance with a feature of this invention, access to the hair chamber for cleaning of hair debris therefrom is provided by the demountable, pivotally supported outer cutter 30. As seen in FIG. 4, the outer cutter 30 comprises a frame having longitudinally extending frame members 50, 52 and 54 which are integrally formed with side wall members 56 and 58. These members provide a support frame for the flexible, apertured, cutter foil member 38 which is secured to the frame.

A means for pivotally supporting the outer cutter on the shaver for providing rotation thereof includes, as illustrated in FIGS. 4–7, pivot rods 60 and 62 which are integrally formed at the opposite ends of the frame member 54 and bearing support means 64 and 66 which are formed by the cutter head. The bearing support means 64 is formed by segments of the cutter head frame side wall member 26 and by segments of the shroud 31. Side frame member 26 (FIG. 5) includes a ridge 68 extending along a portion of its periphery. The shroud 31 includes an extending side wall member 70 which conforms generally with the shape of the frame side wall member 26 and extends to the ridge 68. A channel 72 is formed in the wall member 26 between a depending boss 74 and a wall segment 76. The wall segment 76 includes surface segments 78 and 80, described hereinafter. There is integrally formed in the shroud wall member 70 a post segment 82 having an upper surface 84 thereof. This surface along with the surface segments 78 and 80 form a pocket shaped bearing support means which is open at one side for receiving and supporting the rod 60. The rod 60 is introduced into the bearing support means 64 through the channel 72 which provides a passage in the wall 26 for sliding the rod 60 into this bearing support means.

The bearing support means 66 is similarly formed, as illustrated in FIG. 8, by the side wall member 28 and by an integral upstanding wall segment 90 of the shroud 31. Shroud segment 90 conforms generally with the shape of the frame side wall member 28 and extends to a ridge 92 which is integrally formed therein. A boss 94 is integrally formed in the side wall member 28 and a channel 96 is formed between the boss 94 and an integral wall segment 98 of the wall member 28. The shroud segment 90 includes an integral post shaped segment 100 which with surfaces 102 and 104 of the wall segment 98 provide a pocket shaped bearing support means 66 which is open at one side for receiving and supporting the rod 62. The rod 62 is introduced into this bearing support means 66 through the channel 96 which provides a passage in the wall for sliding the rod 62 into this bearing support means. When the rods 60 and 62 are each positioned in their associated bearing support means, the outer cutter 30 is rotatable on the shaver for exposing the hair chamber.

A resilient means for restraining the outer cutter at the bearing support means 64 and 66 is provided and is adapted to be deflected upon forcible contact by the outer cutter 30 for enabling the removal or the positioning of the outer cutter 30 at the bearing means 64 and 66. This resilient means comprises stud shaped, tapered, upstanding segments 110 (FIG. 5) and 112 (FIG. 8) which are integrally formed with the shroud segments 70 and 90 respectively. As illustrated in FIG. 5, the stud shaped segment 110 is positioned at an outlet of the channel 72 adjacent the bearing support means 64. This segment is spaced apart from the post 82 by a slot 114 which is formed between the post 82 and the segment. An upper portion 116 of the segment 110 is positioned at an outlet of channel 72 for interfering with transfer of the rod 60 from the channel to the bearing support means 64. The stud shaped segment 112 (FIG. 8) is similarly spaced apart from the post 100 and the bearing support means 66 by a slot 118 which is formed between the post 100 and the segment. An upper distal portion 120 of the segment 112 is positioned at the outlet of the channel 96 for interfering with transfer of the rod 62 from this channel to the bearing support means 66.

The shroud 31 is formed of a thermoplastic material which renders the tapered studs 110 and 112 slightly resilient and deformable from their upright positions when forcibly contacted by the rods 60 and 62 respectively. While various materials may be employed to provide the desired resilient characteristic, a preferred material is a thermoplastic resin such as acetal homopolymar. One such commercially available material comprises DELRIN 500, a product of the DuPont Corporation of Wilmington, Del.

An upper portion 116 of the stud 110 is partly rounded and this rounding, during insertion of the cutter 30, allows the rod 60 to wedge between the segment 110 and a lower portion of the wall segment 76. The application of force to rod 60 causes deflection of this upper portion of the stud 110 and permits transfer of the rod 60 from the channel 72 to the bearing support means 64. Similarly, the upper portion 120 of the stud 112 is partly rounded and permits the rod 62 to wedge between the segment 112 and a lower surface of the wall segment 98. Upon the application of force to the pin 62 the stud 112 is deflected and permits transfer of the pin 62 from the channel 96 to the bearing support means 66.

A relatively simple mounting of the outer cutter 30 to the shaver head is illustrated in FIG. 4. The cutter 30 is grasped at its side walls 56 and 58 and the rods 60 and 62 are aligned with and positioned in the channels 72 and 96 respectively. As the rods are advanced in the channels under the influence of hand pressure applied to side walls 56 and 58 the studs 110 and 112 are deflected. This is illustrated in FIG. 6 by the deflection of the stud 110 by the rod 60. The rods continue to advance under hand pressure until they are seated in the bearing support means 64 and 66 as is illustrated in FIG. 7 by the positioning of the rod 60 in the bearing support means 64. The studs 110 and 112 then automatically return to their undeflected positions and are spaced with respect to the bearing support means 64 and 66 for restraining or captivating the rods 60 and 62 in the bearing support means. The resilient studs 110 and 112 resist ordinary escape forces which are exerted thereon during routine use and rotation of the outer cutter 30 but will yield to the application of a hand applied force which is concentrated at the rods.

The outer cutter 30 is readily demounted from the shaver by initially rotating the cutter 30 to expose the hair chamber. A force is then applied to the outer cutter 30 in a direction for causing the studs 110 and 112 to flex and yield as illustrated in FIG. 5 thereby providing a passage for the transfer of the rods from the bearing support means 64, 66 to the channels 72 and 96. This force can be conveniently provided as illustrated in FIG. 4 by application of hand pressure to the side members 56 and 58 of the outer cutter frame.

Figure 2:
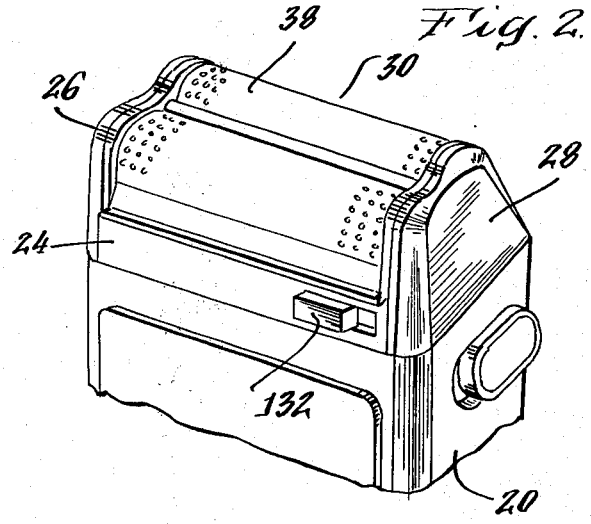
FIG. 2 is a rear perspective view of an upper portion of the shaver of FIG. 1.

During a shaving operation, the outer cutter 30 is secured in position by a latching means which includes a tab segment 130 (FIG. 3) which is engaged by a spring actuated latch hook, not illustrated. The latch hook is released by sliding a push button 132 to the right as viewed in FIG. 2. This causes the latch hook to release the tab 130 and the outer cutter 30 is then hand rotatable to an open position for exposing the hair chamber.

There has thus been described an improved electric dry shaver having a pivotally supported outer cutter which is readily demountable by the user for cleaning a hair chamber of the shaver and for servicing when the need arises. The arrangement is further advantageous in that the pivotal support and demountable features are provided with a relatively non-complex and economic arrangement.

While there has been described a particular embodiment of the invention, it will become apparent to those skilled in the art that variations may be made thereto without departing from the spirit of the invention and the scope of the appended claims.

We claim:

1. An electric dry shaver comprising,
   a. a shaver casing,
   b. a cutter head including an inner and outer cutter disposed on said casing and having upstanding opposed walls,
   c. said outer cutter supported on said cutter head having opposed end portions adjacent said cutter head walls,
   d. said outer cutter being spaced from the casing and defining a hair particle chamber therebetween,
   e. pivotal mounting members on said outer cutter opposed end portions and extending toward the opposed cutter head walls,
   f. means on the opposed cutter head walls for pivotally receiving and supporting the outer cutter for rotatable movement to permit exposure of said chamber, and
   g. resilient means on the opposed cutter head walls for interlocking the outer cutter mounting members to said receiving and supporting means,
   h. said resilient means being deflectable upon forcible contact by the outer cutter mounting members to permit removal or insertion of the outer cutter to said cutter head.

2. The shaver of claim 1 wherein said cutter head includes guide means formed in said opposed cutter head walls for guiding said outer cutter mounting members to the receiving and support means.

3. The shaver of claim 2 wherein said pivotal mounting members include a pair of pivot rods secured to said outer cutter and about which said outer cutter is rotatable for exposing said chamber.

4. The shaver of claim 1 wherein said cutter head includes a shroud having opposed upstanding members and positioned between the casing and the outer cutter for inhibiting passage of hair particles from said chamber into the casing, said receiving and support means formed by surfaces of said shroud members.

5. The shaver of claim 4 wherein said resilient means comprises a segment of said shroud members.

6. The shaver of claim 4 wherein said receiving means include post segments of said shroud members extending parallel to said cutter head walls, and each of said posts includes a surface which forms with said cutter head wall the receiving and support means.

7. The shaver of claim 6 wherein said resilient means comprises stud-shaped segments of the opposed shroud members which extend parallel with said post segments, each stud-shaped segment is spaced adjacent to and apart from said posts by a distance for enabling said outer cutter mounting members to contact a surface of said stud-shaped segment for deflecting the stud-shaped segment away from the receiving and support means.

8. The shaver of claim 7 wherein said guide means comprises channels formed in the opposed cutter head walls for passage of the outer cutter mounting members to a location for engaging and deflecting the stud-shaped segment upon said forcible contact for introducing the outer cutter mounting members into the receiving and support means.

9. The shaver of claim 8 wherein said stud-shaped segment is positioned adjacent an outlet of said guide channel to interfere with movement of said outer cutter mounting member from said receiving and support means toward said channel outlet, said stud-shaped segment deflectable on forcible contact by the outer cutter mounting members away from the channel outlet permitting entry of the outer cutter mounting members into the channel for removal of the frame from the cutter head.

10. The shaver of claim 9 wherein said shroud is formed of a thermoplastic resin.

* * * * *